US007223164B2

(12) United States Patent
Bernard et al.

(10) Patent No.: US 7,223,164 B2
(45) Date of Patent: May 29, 2007

(54) OPTICAL SURFACE-FINISHING TOOL

(75) Inventors: Joël Bernard, Ormesson sur Marne (FR); Mathieu Meynen, Saint-Maur-des-Fosses (FR)

(73) Assignee: Essilor International (Compagnie Generale D'Optique), Charenton le Pont (FR)

( * ) Notice: Subject to any disclaimer, the term of this patent is extended or adjusted under 35 U.S.C. 154(b) by 0 days.

(21) Appl. No.: 10/564,500

(22) PCT Filed: Jul. 12, 2004

(86) PCT No.: PCT/FR2004/001828

§ 371 (c)(1),
(2), (4) Date: Feb. 23, 2006

(87) PCT Pub. No.: WO2005/007340

PCT Pub. Date: Jan. 27, 2005

(65) Prior Publication Data

US 2006/0154581 A1 Jul. 13, 2006

(30) Foreign Application Priority Data

Jul. 16, 2003 (FR) ..... 03 08670

(51) Int. Cl.
*B24D 17/00* (2006.01)

(52) U.S. Cl. ..... 451/490; 451/512; 451/921

(58) Field of Classification Search ..... 451/490, 451/495, 523, 526, 540, 512, 359, 440, 548, 451/921

See application file for complete search history.

(56) References Cited

U.S. PATENT DOCUMENTS

| | | | |
|---|---|---|---|
| 1,665,292 A | 4/1928 | Brown et al. | |
| 1,701,669 A | 2/1929 | Favre | |
| 3,395,417 A | 8/1968 | Matouka | |
| 3,653,857 A | 4/1972 | Field | |
| 4,287,685 A | 9/1981 | Marton | |
| 5,403,231 A | 4/1995 | Duckworth | |
| 7,033,261 B2 * | 4/2006 | Huguet | 451/490 |

FOREIGN PATENT DOCUMENTS

| | | |
|---|---|---|
| DE | 29 30 740 | 2/1981 |
| EP | 1 291 134 | 3/2003 |
| GB | 1 011 741 | 12/1965 |
| GB | 2 210 890 | 6/1989 |
| JP | 2000-317797 | 11/2000 |

* cited by examiner

*Primary Examiner*—Jacob K. Ackun, Jr.
(74) *Attorney, Agent, or Firm*—Young & Thompson

(57) ABSTRACT

An optical surface-finishing tool includes a rigid support (4) having a transverse end surface (13); an elastically-compressible interface (5) which is applied against the end surface (13) such as to cover same; and a flexible buffer (6) which can be applied against the optical surface (2), which is applied against the interface (5) and which covers the interface at least partially, opposite and in line with the end surface (13). The buffer includes a central part (6*a*) which is in line with the end surface (13) and a peripheral part (14) which extends transversely beyond the end surface (13). There is also an elastic return element (15) having a collar (18) which is used to connect the peripheral part (14) to the support (4). Moreover, the collar (18) includes a continuous peripheral part (22) which rests on the peripheral part (14) of the buffer (6) such as to co-operate therewith.

23 Claims, 2 Drawing Sheets

9
1
8
10
7
X
19
15
20
21
23
22
18
4
12
11
23
5
5a
13
16
6a
14
6
14b
3
2

OPTICAL SURFACE-FINISHING TOOL

BACKGROUND OF THE INVENTION

The invention relates to surfacing optical surfaces.

Surfacing means any operation aimed at modifying the surface state of a previously fashioned optical surface. This refers in particular to polishing, softening or depolishing operations aimed at modifying (reducing or increasing) the roughness of the optical surface and/or reducing undulation.

The invention relates to a tool for surfacing an optical surface, which tool comprises a rigid support having a transverse end surface, an elastically compressible interface that is pressed against and covers said end surface, and a flexible buffer adapted to be pressed against the optical surface and which is pressed against and covers at least part of the interface on the side opposite to and in line with said end surface.

To reduce the roughness of the optical surface, the tool is brought into contact with the latter and a sufficient pressure is maintained thereon for the buffer to espouse the shape of the optical surface as a result of deformation of the interface.

While spraying the optical surface with a fluid, it is driven in rotation relative to the tool (or vice-versa) and the tool is swept over it.

It is generally the optical surface that is driven in rotation, its friction against the tool being sufficient to entrain the latter in rotation conjointly with it.

The surfacing operation necessitates an abrasive, which may be contained either in the buffer or in the fluid.

During surfacing, the interface, which is elastically compressible, compensates the curvature difference between the end surface of the tool support and the optical surface so that the same tool is suitable for a range of optical surfaces with different curvatures and shapes.

If the transverse dimension of the tool is comparable to the dimension of the optical surface, which is generally the case when surfacing ophthalmic lenses, the range of optical surfaces that the same tool is capable of surfacing is relatively small.

This type of tool is particularly unsuitable for surfacing optical surfaces of complex shape, known as "freeform" surfaces, in particular aspherical surfaces, which by definition have a non-uniform curvature.

Furthermore, this type of tool is also unsuitable for optical surfaces having too marked a difference of convexity or concavity relative to the tool: in the former case, the edges of the tool lose contact with the optical surface; in the latter case it is the central portion of the tool that loses contact with the optical surface, as a result of which surfacing is incomplete.

There are two ways to enlarge the range of optical surfaces that the same tool is capable of surfacing.

A first is to reduce the diameter of the tool, i.e. its overall transverse dimension, so as to restrict and localize the portion of the optical surface in contact with the tool. The contact of the tool with the surface remains more homogeneous over a localized area of this kind than over the optical surface as a whole.

However, restricting the diameter of the tool reduces its "lift" or "seating" and therefore its stability on the optical surface during surfacing.

It is then necessary to monitor, and therefore to control, the orientation of the tool so that it is optimized at all times, i.e. so that the rotation axis of the tool is colinear or substantially colinear with the normal to the optical surface at the point of intersection of said axis with the optical surface.

Now this kind of control requires the use of complex means such as a numerically controlled machine, the cost of which is generally high and may even prove prohibitive for a surfacing operation.

A second option consists in retaining the same tool diameter but making the interface more flexible, either by increasing its thickness or by reducing its elasticity.

However, because of shear forces, the latter then tends to warp or to be offset laterally, to the detriment of the efficiency and accuracy of the tool. Furthermore, shear causes fast wear, or even destruction, of the interface. Finally, the flexibility of the interface encourages and accentuates the effects of the buffer scraping against the edge of the lens, which may eventually lead to the risk of premature and/or inopportune destruction of the tool.

Given the above, manufacturers of optical surfaces, and in particular manufacturers of ophthalmic lenses, have resigned themselves to having to use a large number of tools with different sizes and curvatures in order to cover the whole of their range of optical surfaces.

SUMMARY OF THE INVENTION

Thus the invention aims in particular to solve the problems previously cited by proposing a surfacing tool which, whilst being suitable for a sufficiently vast range of optical surfaces, in terms of curvature (convexity, concavity) and shape (spherical, toric, aspherical, progressive or any combination thereof, or more generally "freeform"), is stable during surfacing and allows reliable and fast surfacing of good quality at reduced cost.

To this end, the invention proposes a tool for surfacing an optical surface, which tool comprises a rigid support having a transverse end surface, an elastically compressible interface that is pressed against and covers said end surface, and a flexible buffer adapted to be pressed against the optical surface and which is pressed against and covers at least part of the interface on the side opposite to and in line with said end surface, characterized in that the buffer has a central portion that is in line with said end surface and a peripheral portion that is transversely beyond said end surface and return spring means are provided for joining this peripheral portion to the support which means comprise a flat or curved leaf-spring fixed rigidly, on the inside, to the support and having a continuous peripheral portion cooperating with said peripheral portion of said buffer by bearing thereon, directly or through the intermediary of the single interface, means for stabilizing the tool during surfacing being formed by said return means and by said peripheral portion of the buffer, said tool being adapted to perform surfacing essentially in said central portion of said buffer.

In this way it is possible to polish an optical surface whose dimension is much greater than the transverse dimension of the support without encountering the problem of the stability of the tool.

It is then possible to employ the same tool for a relatively large range of optical surfaces to be surfaced.

In particular, the same tool is suitable for surfacing surfaces whose convexity or concavity departs to a relatively great extent from that of the tool, and likewise is particularly suitable for surfacing surfaces of complex shape, in particular of toro-progressive or toro-degressive shape.

It is therefore possible to cover the whole of a given range of lenses with a restricted set of tools varying in terms of curvature, convexity and concavity, which is beneficial from the cost point of view and in particular from the logistical point of view.

It will be noted that the continuous character of the peripheral portion of the leaf-spring of the return means makes surfacing more regular.

Moreover, this continuous character allows cooperation, either directly or through the intermediary of the single interface, between the peripheral portion of the leaf-spring and the peripheral portion of the buffer, without any intermediate element being necessary, which makes fabrication of the tool of the invention particularly simple and economical.

According to features of the leaf-spring that are preferred for reasons of simplicity and convenience of fabrication and of the quality of the results obtained, said leaf-spring is flexible and projects transversely from the support.

In a first embodiment, said leaf-spring is formed by a solid wall.

Alternatively, in another preferred embodiment, said leaf-spring is formed by an apertured wall.

In this embodiment, preferably:

said leaf-spring is apertured by windows of generally trapezoidal shape; and optionally two consecutive windows are separated by a strip of material with parallel edges; and/or the boundary between each window and said continuous peripheral portion is of circular arc shape.

According to other features of the leaf-spring that are preferred for the same reasons:

said leaf-spring is part of a wafer further including a solid portion that said leaf-spring surrounds; and optionally said solid portion is circular; and/or said solid portion has holes through which the shank of a fixing screw is passed.

According to a preferred embodiment, the interface has a central portion that is in line with the end surface of the support and a peripheral portion that is transversely beyond said end surface and is between the peripheral portion of the buffer and the return means.

This increases the flexibility of the assembly.

For example, the peripheral portion of the interface when unstressed assumes the shape of a ring around the central portion of the interface.

Moreover, in one particular embodiment, the interface is of one-piece construction and its central portion and peripheral portion form a single component, thereby simplifying production thereof.

Thus, for example, when unstressed the interface assumes the shape of a disk.

Moreover, the buffer may be of one-piece construction, its central portion and peripheral portion forming a single component, thereby simplifying production thereof.

For example, the buffer comprises a plurality of petals projecting transversely from its central portion, which corresponds to the usual shape of surfacing buffers.

Alternatively, said peripheral portion takes the form of a ring around the central portion in such a way that the buffer is of one-piece construction and when unstressed assumes the shape of a disk.

The end surface may be plane, concave or convex so that a large number of optical surfaces can be surfaced with a limited number of tools.

BRIEF DESCRIPTION OF THE DRAWINGS

Other features and advantages of the invention will become apparent in the light of the following description of one embodiment of the invention provided by way of nonlimiting example, the description being given with reference to the appended drawings, in which.

DESCRIPTION OF THE PREFERRED EMBODIMENTS

Figure 1:
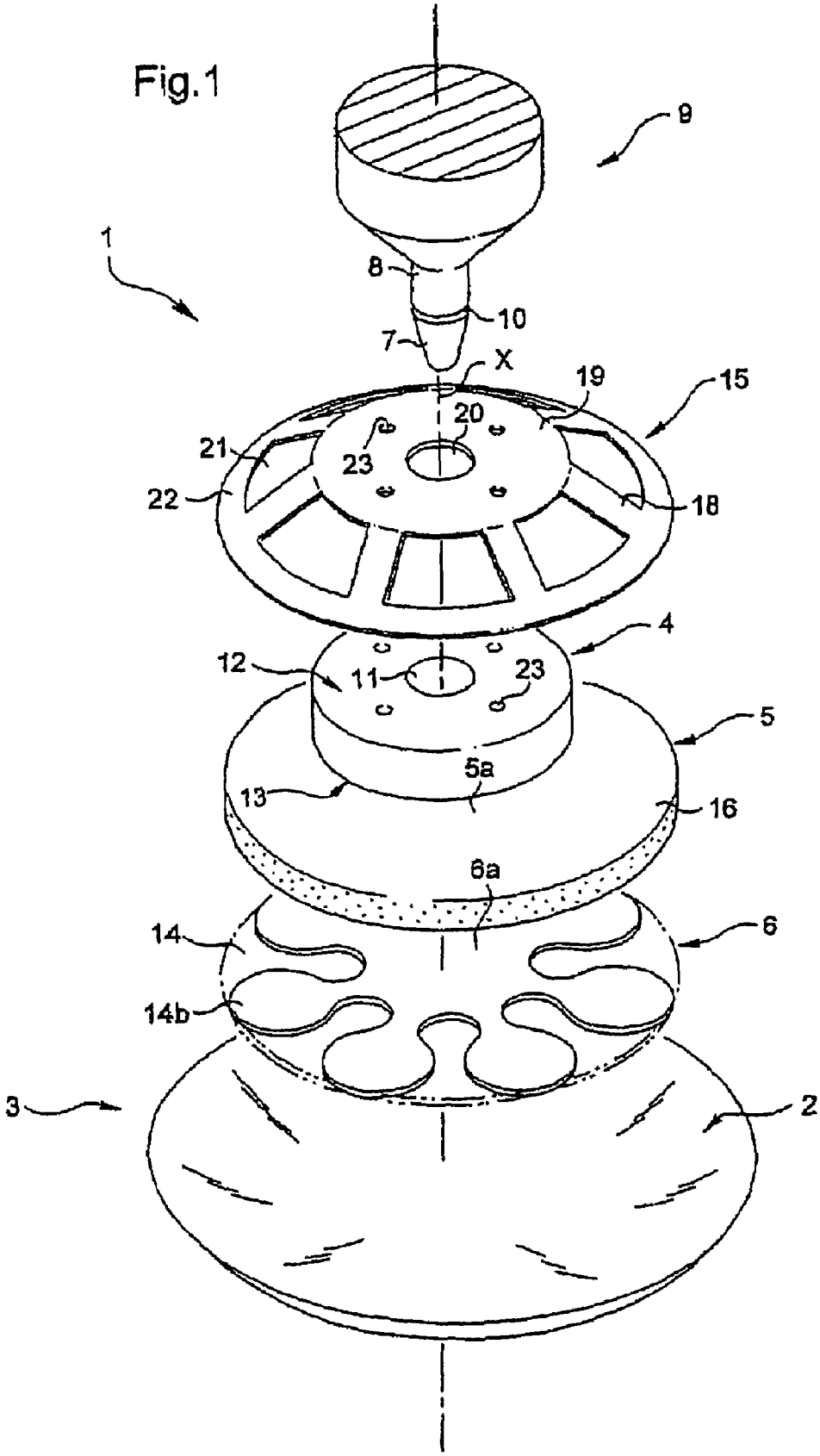
FIG. 1 is an exploded perspective view of a tool conforming to the invention, a base for receiving said tool and an ophthalmic lens having an optical surface to be surfaced.

FIG. 1 shows a tool 1 for surfacing an optical surface 2, in this instance one face of an ophthalmic lens 3, which in this case is a concave surface.

The tool 1 is formed of a stack of at least three components, namely a rigid component 4, an elastically compressible component 5 and a flexible component 6; these components are respectively referred to hereinafter as the support, the interface and the buffer.

As may be seen in FIG. 1, the support 4 is an overall cylinder with symmetrical revolution with an axis X of symmetry that defines a longitudinal direction.

The support 4 is designed to cooperate in the manner of a hub with the spindle 7 at the end of the pin 8 that is part of a base 9 for receiving the tool 1.

The spindle 7 has a generally conical contour with a rounded end. Between the spindle 7 and the rest of the pin 8 is a groove 10 (shown only in FIG. 1) for receiving an elastic ring (not shown) attached to the support 4 to retain the tool 1 to the base 9.

To accommodate the spindle 7, the support 4 has a blind hole 11 formed in the face 12 of the support 4 that is seen at the top in the drawings.

The bottom of the hole 11 is rounded like the end of the spindle 7, for which it provides a bearing surface. The remainder of the hole 11 is more flared than the lateral wall of the spindle 7, as may be seen in FIGS. 2 and 3.

Accordingly, the support 4, and more generally the tool 1, when it is received on the base 9, is able to turn freely with respect to the latter about the axis X, coinciding with that of the pin 8 or inclined thereto by up to approximately 30 degrees.

On the side opposite its face 12 in which the hole 11 is formed, the support 4 has a substantially transversely extended end surface 13 against which the interface 5 is pressed, covering it.

The buffer 6 is pressed against the interface 5 on the other side thereof to the support 4.

To be more precise, the buffer 6 covers at least in part the interface 5 opposite and in line with the end surface 13.

By means of an abrasive contained in the spraying fluid or incorporated into the buffer 6 itself, the rubbing of the buffer 6 against the optical surface 2 removes surface material from the optical surface 2 in order to modify the surface state, as explained below.

The buffer 6 has a central portion 6*a* that is in line with the end surface 13 and a peripheral portion 14 that is transversely beyond the end surface 13.

The peripheral portion 14 is connected to the support 4 by return spring means 15.

The peripheral portion 14 is in line with the central portion 6*a* and, at rest, substantially coplanar with it.

Figure 2:
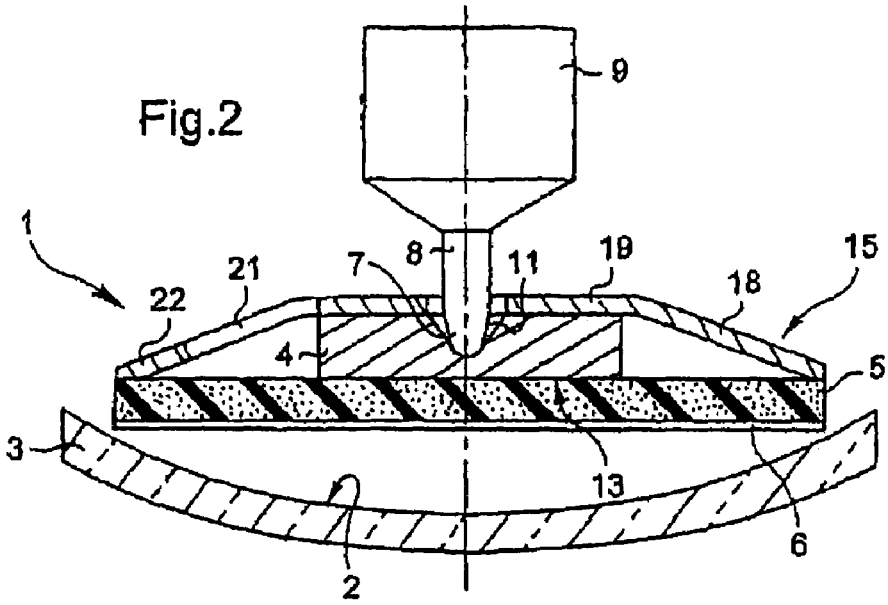
FIG. 2 is a sectional view in elevation of the base of the ophthalmic lens and the tool from FIG. 1, which is represented assembled, at rest, in place on the pin.
Figure 3:
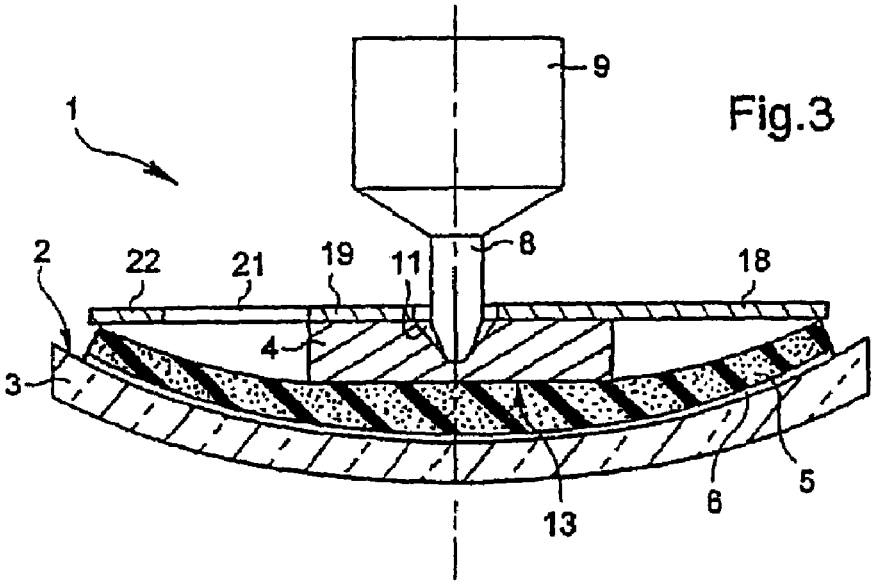
FIG. 3 is a view analogous to FIG. 2, but during surfacing rather than at rest.

In a preferred embodiment shown in FIGS. 1 to 3, the buffer 6 is of one-piece construction, the peripheral portion 14 being joined to the central portion 6*a* so that in fact they form a single component.

In a preferred embodiment depicted in thicker line in FIG. 1, the buffer 6 is in the shape of a flower and thus comprises a plurality of petals 14*b* projecting transversely from the central portion 6*a* to form the peripheral portion 14 of the buffer 6 and each extending transversely beyond the end surface 13.

In a variant represented in chain-dotted outline in FIG. 1, the peripheral portion 14 takes the form of a ring 14*a* around the central portion 6*a*.

In this case, the buffer 6, when it is of one-piece construction, assumes the shape when it is unstressed of a disk whose thickness is small compared to its diameter, as shown in FIG. 1, the peripheral portion 14 therefore forming a flange relative to the end surface 13.

Return means 15 described later may be placed directly between the support 4 and the peripheral portion 14 of the buffer 6, i.e. the flange whereof the periphery is illustrated in chain-dotted line in FIG. 1 or the petals 14*b* in practice.

However, in a preferred embodiment shown in the figures, the interface 5 comprises not only a central portion 5*a* that is in line with the end surface 13 but also a peripheral portion 16 that is transversely beyond the end surface 13.

For example, this peripheral portion 16 is in line with the central portion 5*a* and, when it is unstressed, assumes the shape of a ring around the central portion 5*a*, in fact between the peripheral portion 14 of the buffer 6 and the return means 15.

As may be seen in FIGS. 1 to 3, the interface 5 is of one-piece construction, its central portion 5*a* and peripheral portion 16 being joined together to form a single component, the peripheral portion 16 forming a flange relative to the end surface 13.

Accordingly, when it is unstressed, the one-piece construction interface 5 assumes the shape of a disk whose thickness is small compared to its transverse dimension (i.e. its diameter), for example.

If the interface 5 and the buffer 6 are both of one-piece construction, they have comparable transverse dimensions. In particular, when each takes the form of a disk, for convenience of manufacture they are preferably of the same diameter. However, it is equally possible to use a buffer having a diameter different from that of the interface, in particular a greater diameter, in order to attenuate the effects of the edge of the tool on the worked surface.

The return means 15 are described next.

They comprise a leaf-spring 18 that projects transversely from the support 4 and is connected rigidly thereto on the inside whereas its peripheral portion, which is continuous, cooperates with the peripheral portion 14 of the buffer 6 by bearing thereon, through the intermediary of the peripheral portion 16 of the interface 5 in this preferred embodiment, although this cooperation could equally be direct.

As a result, a force applied longitudinally to the peripheral portion 14 in line with the leaf-spring 18 deforms it, a reaction force opposite to said force being exerted on the peripheral portion 14.

In an embodiment shown in FIGS. 1 to 3, the return means 15 in fact take the form of a wafer fixed rigidly to the support 4.

This wafer comprises a solid portion 19 extending between a central hole 20 and the leaf-spring 18, which has windows 21 in it between the solid portion 19 and a continuous solid border 22 that forms the peripheral portion of the leaf-spring 18.

To fix the wafer 25 to the support 4, its solid portion 19 has holes 23 through which the shank of a screw is passed, corresponding threaded holes 24 being provided on the support 4, in the face 12.

In the present example, at rest, the leaf-spring 18 has a frustoconical conformation while its solid portion 19 is flat, like the face 12 of the support 4, the wafer 15 being concave on the side of the support 4, the interface 5 and the buffer 6.

There are seven windows 21 in the leaf-spring 18 and they are regularly arranged, each having the same globally trapezoidal contour.

To be more precise, the boundary between each window 21 and the border 22 is of circular arc shape, and likewise the boundary between each window 21 and the solid portion 19. The other sides of the windows 21 are oriented in a substantially radial direction, each strip of material situated between two consecutive windows 21 having parallel edges.

In the present example, the wafer 15 is molded from plastics material with a constant thickness that is small compared to its diameter.

Although several embodiments are provided, as mentioned above, it has been found that the tool 1 corresponding to the embodiment shown in FIGS. 1 to 3 provides particularly satisfactory surfacing.

In this embodiment, the buffer 6 and the interface 5 are both of one-piece construction, the interface 5 taking the form of a disk of material, the buffer 6 being flower-shaped, and the return means 15 taking the form of a wafer as previously described, the continuous peripheral border 22 of which bears on the peripheral portion 16 of the interface 5 on the side opposite the buffer 6.

In the embodiment shown, the diameters of the interface 5, the buffer 6 and the wafer 15 are at least twice that of the support 4.

Moreover, in the case of surfacing an ophthalmic lens, the diameters of the interface 5 and the buffer 6 are made substantially equal to the diameter of the lens 3 so that the diameter of the support 4 is much less than the diameter of the lens 3.

Figure 4:
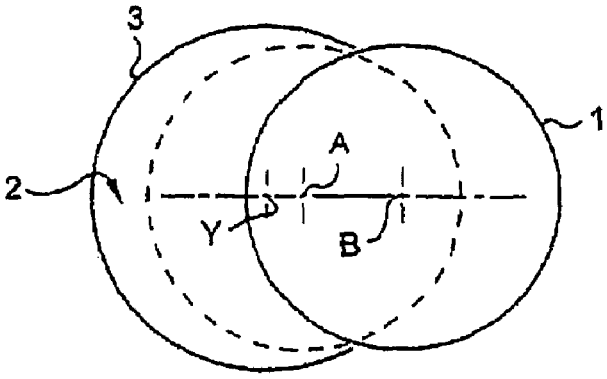
FIG. 4 is a diagrammatic plan view representing an ophthalmic lens during surfacing by means of a tool conforming to the invention, the tool being shown when sweeping the optical surface in two positions, one of which is shown in dashed line.

FIGS. 2 to 4 depict the use of the tool 1.

Here the tool is being used to surface or soften an aspherical concave face 2 of an ophthalmic lens.

The lens 3 is mounted on a rotary support (not shown) which drives it in rotation about a fixed axis Y (FIG. 4).

The tool 1 is pressed against the face 2 with sufficient force for the buffer 6 to espouse its shape, as shown in FIG. 3. The tool 1 is free to rotate here and is off-center compared to the optical surface 2. The tool may be driven in rotation by appropriate means.

The friction between the optical surface 2 and the buffer 6 is sufficient to drive rotation of the tool 1 in the same direction as the lens 3 about the spindle 7.

The optical surface 2 is sprayed with a fluid that is abrasive or non-abrasive according to whether the buffer has this function itself or not.

To sweep the whole of the optical surface 2, the base 9 is moved during surfacing along a radial trajectory, the point of intersection of the axis of symmetry of the pin 8 with the optical surface 2 moving to and fro between two change of direction points, namely an inner change of direction point A and an outer change of direction point B, both these points being at a distance from the rotation axis Y of the lens 3.

Thanks to the compressibility of the central portion 5*a* of the interface 5, the central portion 6*a* of the buffer 6 is deformed to espouse the shape of the optical surface 2.

Thanks to deformation of the leaf-spring 18, the peripheral portion 14 of the buffer 6 is deformed to espouse the shape of the optical surface 2.

The continuous peripheral border 22 cooperating in simple bearing fashion with the combination of the buffer 5 and the interface 6, the relative position of the border 22 and the combination 5–6 can vary during deformation, as may be seen by comparing FIGS. 2 and 3.

The continuity of the peripheral border 22 achieves some circumferential regularity of the return force that is exerted, and therefore a certain regularity of the surfacing effected. In this regard it will be noted, for example, that if the leaf-spring 18 were replaced by a star-shaped part with branches shaped like the windows 21, it would be preferable to provide between the end of the branches and the interface 5 or the buffer 6 a continuous annular intermediate part, whereas with the continuous peripheral border good results are obtained without any intermediate part.

Given the rigidity of the support 4, material is removed mostly in line with the end surface 13, i.e. material is essentially removed by the central portion 6*a* of the buffer 6.

The peripheral portions 14 of the buffer 6 and 16 of the interface 5 have an essentially stabilizing role, firstly because of the increased lift or seating of the tool 1 relative to a standard tool whose buffer and interface would be limited to the central portions 5*a*, 6*a* and secondly thanks to the return wafer 15, which maintain permanent contact between the peripheral portion 14 of the buffer 6 and the optical surface 2.

As a result of this, regardless of the location of the tool 1 on the optical surface 2, and regardless of its rotation speed, its rotation axis X is permanently colinear or substantially colinear with the normal to the optical surface 2, so that the orientation of the tool 1 is optimized at all times.

In the embodiment shown, the end surface 13 of the support 4 is plane.

Thus the tool 1 is suitable for surfacing a certain range of optical surfaces 2 with different curvatures.

In a variant of the tool 1 that is not shown, the leaf-spring 18 of the wafer 15 is shaped differently. In particular it is curved in the same direction, but more so (the interface 5 and the buffer 8 are then curved at rest with their convex side facing toward the support 4 and the wafer 15); flat at rest, i.e. coplanar with the central portion 19 (the interface 5 and the buffer 6 are then curved at rest as shown in FIG. 3, i.e. with their concave side facing the support 4 and the wafer 15); or with the opposite curvature, i.e. with the convex side of the wafer 15 facing the support 4, the interface 5 and the buffer 6 (the latter two are then more curved at rest than in FIG. 3).

This first variant is more particularly intended for convex optical surfaces whereas the embodiment shown and the other two variants are more particularly intended for concave optical surfaces.

In another variant that is not shown, the end surface 13 of the support 4 is convex, rather than flat, the tool then being intended for optical surfaces having a more pronounced concavity, or the end surface 13 of the support 4 is concave, the tool then being intended for optical surfaces of pronounced convexity.

It is possible, of course, to combine the concave or convex end surface 13 with different shapes of wafer 15 as described above.

A total of three tools whose end surfaces 13 are respectively plane, convex and concave, are sufficient to cover a wide range of convex and concave optical surfaces to be surfaced of varied shape: spherical, toric, progressive aspherical or any combination thereof, or more generally of the freeform type.

In different embodiments of the return means 15 (not shown), there is still a leaf-spring such as the leaf-spring 18, with a continuous edge, but this leaf-spring is solid or apertured in a different way.

It has been shown that a tool 1 as previously described is used in a manner that corresponds to a standard method well known to the person skilled in the art, so that no particular adaptation of the machines usually employed is necessary.

The invention claimed is:

1. Tool (1) for surfacing an optical surface (2), which tool comprises a rigid support (4) having a transverse end surface (13), an elastically compressible interface (5) that is pressed against and covers said end surface (13), and a flexible buffer (6) adapted to be pressed against the optical surface (2) and which is pressed against and covers at least part of the interface (5) on the side opposite to and in line with said end surface (13), characterized in that the buffer has a central portion (6*a*) that is in line with said end surface (13) and a peripheral portion (14) that is transversely beyond said end surface (13) and return spring means are provided (15) for joining this peripheral portion (14) to the support (4) which means comprise a flat or curved leaf-spring (18) fixed rigidly, on the inside, to the support (4) and having a continuous peripheral portion (22) cooperating with said peripheral portion (14) of said buffer (6) by bearing thereon, directly or through the intermediary of the single interface (5), means for stabilizing the tool during surfacing being formed by said return means (15) and by said peripheral portion (14) of the buffer (6), said tool being adapted to perform surfacing essentially in said central portion (6*a*) of said buffer (6).

2. Tool according to claim 1, characterized in that said leaf-spring (18) is flexible and projects transversely from the support (4).

3. Tool according to claim 2, characterized in that said leaf-spring is formed by a solid wall.

4. Tool according to claim 2, characterized in that said leaf-spring (18) is formed by an apertured wall.

5. Tool according to claim 4, characterized in that said leaf-spring (18) is apertured by windows (21) of generally trapezoidal shape.

6. Tool according to claim 5, characterized in that two consecutive windows (21) are separated by a strip of material with parallel edges.

7. Tool according to claim 5, characterized in that the boundary between each window (21) and said continuous peripheral portion (22) is of circular arc shape.

8. Tool according to claim 1, characterized in that said leaf-spring (18) is part of a wafer further including a solid portion (19) that said leaf-spring surrounds.

9. Tool according to claim 8, characterized in that said solid portion (19) is circular.

10. Tool according to claim 8, characterized in that said solid portion has holes (23) through which the shank of a fixing screw is passed.

11. Tool according to claim 1, characterized in that the interface (5) has a central portion (5*a*) that is in line with said end surface (13) and a peripheral portion (16) that is transversely beyond said end surface (13) and is between the peripheral portion (14) of the buffer (6) and the peripheral portion (22) of the leaf-spring (13) of the return means (15).

12. Tool according to claim 11, characterized in that the peripheral portion (16) of the interface (5) when unstressed assumes the shape of a ring around the central portion (5*a*) of the interface (5).

13. Tool according to claim 11, characterized in that the interface (5) is of one-piece construction and its central portion (5*a*) and peripheral portion (16) form a single component (5).

14. Tool according to claim 13, characterized in that when unstressed the interface (5) assumes the shape of a disk.

15. Tool according to claim 1, characterized in that the buffer (6) is of one-piece construction, the central portion (6*a*) and peripheral portion (14) forming a single component (6).

16. Tool according to claim 15, characterized in that the buffer (6) comprises a plurality of petals (14*b*) projecting transversely from the central portion (6*a*).

17. Tool according to claim 15, characterized in that said peripheral portion (14) takes the form of a ring (14*a*) around the central portion (6*a*).

18. Tool according to claim 17, characterized in that the buffer (6) is of one-piece construction and when unstressed assumes the shape of a disk.

19. Tool according to claim 1, characterized in that the end surface (13) of the support (4) is plane.

20. Tool according to claim 1, characterized in that the end surface (13) of the support (4) is convex.

21. Tool according to claim 1, characterized in that the end surface (13) of the support (4) is concave.

22. Tool according to claim 1, wherein an entirety of said end surface (13) of said rigid support (4) is at a same level so that an entirety of said end surface bears against said interface (5) to cause said tool to perform surfacing essentially in said central portion (6*a*).

23. Tool according to claim 22, wherein said interface (5) covers an entirety of said end surface.

* * * * *